US005555734A

United States Patent [19]

Welch et al.

[11] Patent Number: 5,555,734

[45] Date of Patent: Sep. 17, 1996

[54] METHOD FOR REDUCING SEDIMENT PRECIPITATION ON HEAT EXCHANGERS SUCH AS WATER PRECHILLERS FOR ICE MACHINES

[75] Inventors: Daniel L. Welch, Del Rio; Jeff L. Love, Leander, both of Tex.

[73] Assignee: Maximicer, Austin, Tex.

[21] Appl. No.: 353,668

[22] Filed: Dec. 12, 1994

Related U.S. Application Data

[63] Continuation-in-part of Ser. No. 218,348, Mar. 28, 1994, Pat. No. 5,379,603, which is a continuation-in-part of Ser. No. 39,844, Mar. 30, 1993, abandoned.

[51] Int. Cl.[6] ..... F25C 1/12

[52] U.S. Cl. ..... 62/66; 62/348; 165/134.1; 285/53

[58] Field of Search ..... 62/348, 66; 285/53; 165/134.1, 186

[56] References Cited

U.S. PATENT DOCUMENTS

| | | | |
|---|---|---|---|
| 2,669,465 | 2/1954 | Newell | 285/53 |
| 2,921,447 | 1/1960 | Gottschalk | 62/348 X |
| 3,686,747 | 8/1972 | Bagnulo | 285/53 X |
| 3,705,735 | 12/1972 | Davidson et al. | 285/53 |
| 3,871,687 | 3/1975 | Dockree | 285/53 |
| 3,993,331 | 11/1976 | Schwarz | 285/53 |
| 5,114,190 | 5/1992 | Chalmers | 285/53 |

*Primary Examiner*—William E. Tapolcai
*Attorney, Agent, or Firm*—Michael P. Breston

[57] ABSTRACT

This invention relates to a method for exchanging heat between one fluid and another fluid by using a heat exchanger, and circulating at least the one fluid through a fluid flow channel within a body made of a material which is a good heat conductor as well as a good conductor of electric current, so that the fluids become in heat exchange relationship through the walls of the body. The improvement includes insulating the body from electric current flow therethrough, so that, in use, the tendency for progressive precipitation of solid particles from the fluids onto the wetted surfaces of the body is substantially reduced.

13 Claims, 2 Drawing Sheets

METHOD FOR REDUCING SEDIMENT PRECIPITATION ON HEAT EXCHANGERS SUCH AS WATER PRECHILLERS FOR ICE MACHINES

BACKGROUND OF THE INVENTION

1. Reference to Related Applications

This application is a continuation-in-part of application Ser. No. 08/218,348 filed Mar. 28, 1994, now U.S. Pat. No. 5,379,603, which is a continuation-in-part of abandoned application Ser. No. 08/039,844, filed Mar. 30, 1993.

2. Field of the Invention

This invention generally relates to the art of exchanging heat between a heating fluid and a cooling fluid by using a heat exchanger body that is made of a material which is a good heat conductor as well as a good conductor of electric current. The heating fluid is circulated through the exchanger body while the cooling fluid surrounds the body inside a casing.

In a specific aspect, as described in our said patent, this invention relates to a novel heat exchanger for exchanging heat between the warm tap water flowing into an ice maker machine and the near freezing waste water ejected by it.

3. Description of the Prior Art

The prior art references in said patent incorporated herein by reference.

In an ice maker machine, pure water is initially normally frozen into ice, and the remainder near freezing surplus water contains a substantially higher mineral content that the tap water. Thus, at the end of one or more ice "harvest" cycles, a considerable volume of surplus 33°–34° F. cold waste water becomes available for dumping into the sewer together with its mineral content. While the cold energy within this waste water is beneficially utilized by our water prechiller, as described in our said patent, its mineral content, on the other hand, can become a serious handicap because a portion thereof becomes attracted to the walls of the heat exchanger's body, which is being cooled by the waste water as it flows from the ice machine to the drain through the heat exchanger casing.

Of course, the volume of this sediment content is larger when the tap water being prechilled itself contains solid particles typically lime. But the exact sediment content is unpredictable and can vary from region to region.

This mineral content makes the ice machine less energy efficient because its productivity is a function, among other things, of its ambient air temperature, of the temperature of the tap water used to make the ice, and of the volume of minerals deposoited on the heat exchanger's walls. The lower the tap water's temperature is, the higher will be the machine's ice yield during each ice "harvest". Even if the air temperature remains the same, lowering the tap water's temperature by about 20° F. can considerably increase the machine's ice yield. In addition to boosting the ice yield, other tangible benefits will be obtained including: savings on the amount of required floor space for the ice maker, on its cost and installation, and on its operating and maintenance expenses. But, the efficiency of an ice machine, as well as that of our tap water prechiller, varies inversely with the volume of mineral buildup which occurs on their respective heat exchange surfaces. Periodically and regularly flushing and cleaning such heat exchange surfaces can somewhat alleviate but not eliminate the mineral buildup problem. But, for many reasons, such cleanouts are frequently not carried out by those in charge of the ice machine's maintenance.

Therefore, there has been a long lasting need in the heat exchanger art for an arrangement which would tend to reduce the progressive precipitation of sediments on the internal and external surfaces of a heat exchanger's wetted metallic surfaces.

When we filed our said application Ser. No. 08/218,348, which issued as said patent, we expected that the tap water prechiller described therein would in due course, like other heat exchangers, buildup an unavoidable and substantial hard mineral crust, especially if it is used in parts of the country where the warm tap water originates from water wells situated within lime formations. But, we have unexpectedly discovered that the heat exchanger body in our tap water prechiller exhibited a much lower attraction to minerals than we expected. Even after a relatively long time in service, the buildup of minerals on our heat exchanger body was substantially smaller than expected, even when used for prechilling "hard" tap waters originating from wells located in lime formations.

To find a cause and effect relationship, we carried out comparative studies which unexpectedly revealed that the particular type of non-conductor bulkhead union or connector used on our heat exchanger, which was shown on the drawings in both of our said prior patent applications, was responsible for the unexpected favorable results, i.e, for the much reduced rates of sediment buildups.

Using our novel tap water prechiller, less cleanings thereof are required, thereby reducing maintenance costs; less damage is sustained by its internal parts, thereby considerably prolonging the operational life thereof, and allowing the ice machine's bin to fill up faster with ice during periods of peak demand.

SUMMARY OF THE INVENTION

The method involves exchanging heat between one fluid and another fluid by using a heat exchanger body and circulating at least said one fluid through a fluid flow channel within the body made of a material which is a good heat conductor as well as a good conductor of electric current, so that the fluids become in heat exchange relationship through the walls of the heat exchanger's body. The improvement of this invention includes insulating the heat exchanger's body from electric current flow therethrough, so that, in use, the tendency for progressive precipitation of solid particles from the two fluids, that are in heat exchange relationship, onto the wetted surfaces of the heat exchanger's body is substantially reduced.

In a specific aspect of the invention, at least one end of the fluid flow channel within the heat exchanger's body includes a pipe connector or coupler made of a material exhibiting a high resistivity to the flow of electric current, thereby insulating the body from electric current flow therethrough, so that the tendency for progressive precipitation of minerals on the heat exchanger's body is substantially reduced, even when the tap water flowing therethrough originates from wells located in lime formations. The preferred pipe coupler is a bulkhead connector made of a non-conductor material, which is typically a plastic material for ease of fabrication. It serves a double purpose: it detachably and sealingly interconnects the heat exchanger's body to a fluid carrying metal pipe, and it prevents electric current flow through the heat exchanger's body.

In our said water prechiller, the heat exchanger's body is a copper coil having a plurality of spiral turns followed by a substantially straight copper tube portion within and surrounded by the coil turns. The one fluid is the warm tap water being prechilled for use by an ice maker machine to make ice cubes and the like, and the other fluid is the near freezing waste water ejected by it as a result of the ice making process.

DESCRIPTION OF PREFERRED EMBODIMENTS

Figures 1, 2, 3:
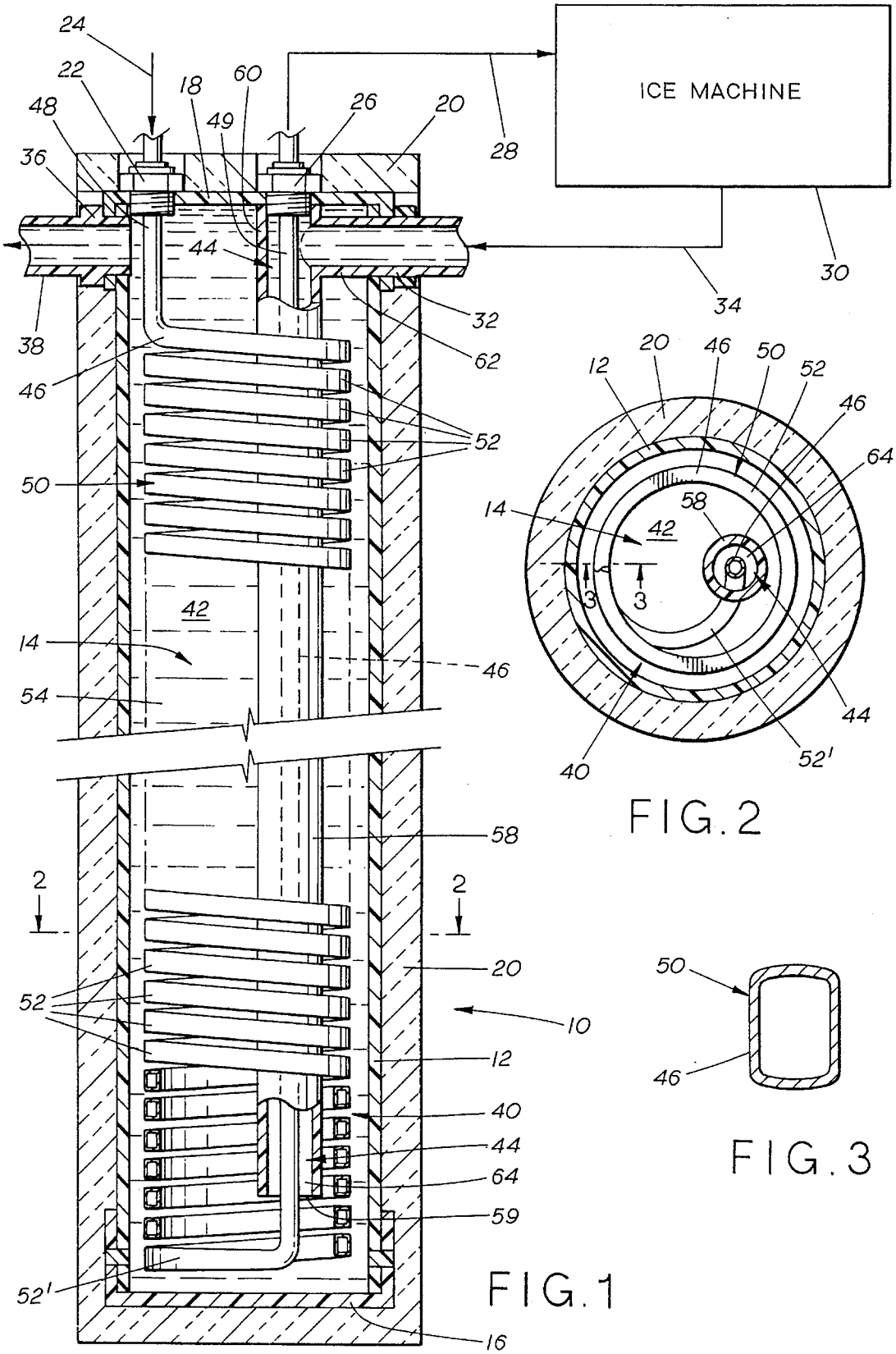
FIG. 1 is a longitudinal sectional view of the prechiller of the present invention.
FIG. 2 is a sectional view of the prechiller taken on line 2—2 of FIG. 1.
FIG. 3 is a sectional view on line 3—3 of FIG. 2 of the long tubing from which the heat exchanger is made up.

FIGS. 1–3 of the drawings use the same reference characters as are used in our said prior patent applications. In particular, the non-conductor bulkhead connectors were generally designated as 22 and 26, but the description thereof only dealt with their ability to detachably and sealingly interconnect the pipes leading to and out of the heat exchanger's body 40, and not with their additional ability also to prevent electric current flow through the heat exchanger.

In the drawings, numeral 10 generally designates an apparatus 10 for prechilling the warm tap water, fed into an ice maker machine 30 to make ice cubes and the like, with the near freezing mineral contaminated waste water 54 ejected by the machine as a result of the ice making process.

In its preferred embodiment and with reference to FIGS. 1–2, prechiller 10 has an elongated casing 12, preferably upright, which encloses a reservoir 14. Casing 12 can be a cylindrical pipe section having a bottom cap 16 and a top cap 18. It is entirely covered with a layer of thermal insulation 20.

Within reservoir 14 is a heat exchanger body 40 having a first stage 42 and a second stage 44, both sharing a single continuous tubing 46 of great length compared to the length of casing 12. Tubing 46 is made of a good thermal conductor preferably copper which is also a good conductor of electricity.

Top cap 18 has a non-conductor bulkhead connector 22 for receiving tap water from line 24, and a non-conductor bulkhead connector 26 through which the prechilled tap water flows out into line 28 of ice machine 30, such as an ice cube maker used in restaurants, bars, hotels, schools, hospitals, etc.

The bulkhead connectors 22 and 26 insulate the tap water copper feed line 28 from the copper heat exchanger 40 so that no electric current can flow therebetween. For that purpose, only one bulkhead connector either 22 or 26 could be sufficient, because each is made of a non-conductor material which is typically a plastic material for ease of fabrication. Such a material exhibits a high resistivity to the flow of electric current therethrough.

The inlet end 48 of tubing 46 is removably and sealingly coupled to connector 22 (FIGS. 1, 4 and 5) and the outlet end 49 of tubing 46 is removably and sealingly coupled to connector 26. Hence, each connector 22 or 26 serves a double purpose. For example, connector 22 (1) detachably and sealingly interconnects pipes 24 and 48 together, and (2) prevents electric current flow between tap water copper feed line 28 and copper heat exchanger 40.

Tubing 46 in first stage 42 is wound into a coil 50 having spiral turns 52 that are near to the inner wall of casing 12 (FIG. 2), thereby substantially increasing the length of the path of travel for the tap water within the casing.

In such coiling, the tube's sectional area is purposely altered from circular to substantially rectangular or oval (FIG. 3). It is believed that such an alteration favorably alters the heat exchange surface area relative to the volume of tap water contained within tubing 46.

The portion of tubing 46, in second heat exchanger stage 44, is substantially straight and upright and hereinafter will be also designated by the numeral 44. Straight tube 44 is inside of and completely surrounded by turns 52. The bottom end of tube 44 merges smoothly with the lowest turn 52'.

In the preferred embodiment, along substantially its entire length, tube 44 is surrounded by a concentric upright conduit 58, having an open end 59 and a closed off top end 60. Conduit 58 is made of a poor thermal conductor material. In a less preferred embodiment (not shown), tube 44 can be outside of and parallel to conduit 58.

The side wall of top cap 18 has a socket 32 that receives from machine 30 ice cold waste water 54 on line 34, and a socket 36 which allows excess waste water 54 to escape to drain line 38.

The space between tube 44 and the inner wall of conduit 58 forms an elongated chamber 64 for receiving the waste water 54 from socket 32 through a coupling 62.

In the first ice harvest cycle, from line 34 of ice maker 30, ice cold waste water 54 flows downwardly through along and around straight tube 44, through open bottom end 59 of chamber 64, which is also the bottom of reservoir 14, and then flows upwardly towards the top of reservoir 14 along and around the coil's turns 52.

Conduit 58 thermally isolates the colder waste water 54 in chamber 64 from the warmer waste water 54 within the rest of reservoir 14.

The inlet 48 of tubing 46 receives from line 24 tap water under pressure which circulates downwardly through turns 52. The tap water flows spirally toward the lowest turn 52', thence upwardly within straight tube 44, and through its tap water outlet 49 into feed line 28 of machine 30 for making ice.

The waste water 54 in reservoir 14 cools the downwardly circulating tap water to progressively lower temperature levels.

The same tap water is further cooled to progressively lower temperature levels as it flows upwardly in straight tube 44 from the lowest turn 52' of coil 50, because the arriving counter flowing coldest waste water 54 from machine 30 maximally lowers the temperature of the tap water in tube 44 before it flows out through outlet 49 into feed line 28.

In chamber 64 the waste water's temperature progressively increases from its top to the bottom of reservoir 14. In reservoir 14 the waste water's temperature progressively increases from its bottom to its top, thereby resulting in a progressive rise in the temperature of the waste water surrounding tubing 46 from inlet socket 32 to to outlet socket 36, whereat it has its highest temperature, while the tap water has its lowest temperature within tube 44 at the level of socket 32.

As a result, the temperature of the tap water within the entire length of tubing 46 is progressively and continuously lowered from its inlet end 48 to its outlet end 49.

The changes in the temperature in the waste water 54 per unit of vertical height enhances the heat transfer from the tap water flowing through tubing 46 to the surrounding waste water 54. It is believed that the substantially rectangular sectional area of tubing 46 tends to improve the amount of heat transferred in a unit of time across a unit of surface area of heat exchanger 40, and in a unit of length of tubing 46.

In summary, the heat exchanger's first stage 42 first prechills the fresh tap water with warmed up waste water 54 received from second stage 44, which further prechills the tap water received from first stage 42 with fresh ice cold waste water 54 received from line 34 into chamber 64.

Hence, the cooling energy within the waste water 54 discharged from ice machine 30, which would otherwise be wasted, is optimally reclaimed by heat exchanger 40 which removes heat energy from the tap water prior to injecting it into the ice making section of machine 30.

After a relatively long time in use, we discovered that the buildup of minerals on heat exchanger 40 was substantially smaller than expected. To find a cause and effect relationship, we carried out comparative studies which revealed that the non-conductor bulkhead connectors 22 and 26, which we used and have shown in FIGS. 1–3 of our said prior applications, were responsible for the unexpected favorable results, i.e, for the much reduced rates of mineral buildups.

We have discovered that the tendency for progressive precipitation of minerals from the waste water 54 flowing externally of the heat exchanger 40, and from the tap water flowing internally of the heat exchanger, onto the wetted surfaces thereof is substantially reduced, even when the tap water flowing therethrough originates from wells located in lime formations.

Figure 4:
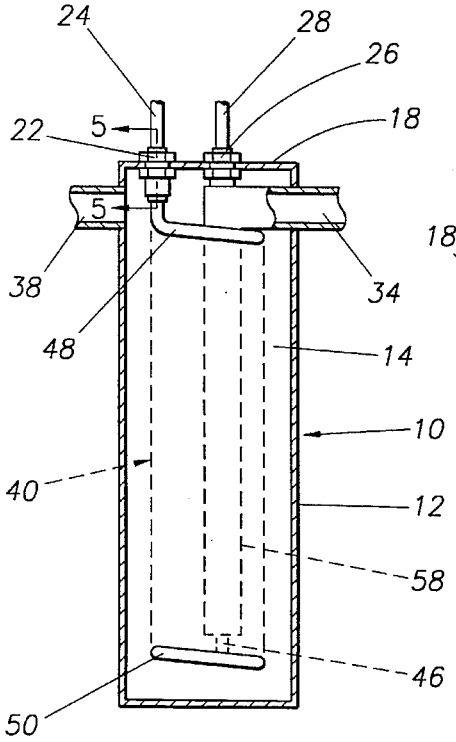
FIG. 4 is a schematic view of the prechiller with the preferred non-conductor bulkhead connectors.
Figure 5:
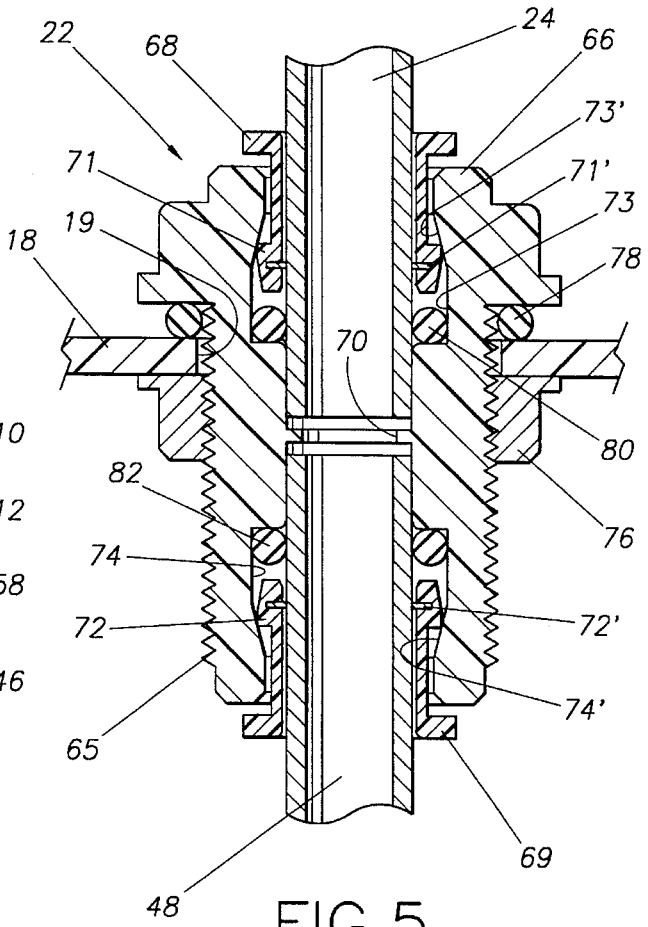
FIG. 5 is an elevational sectional view of the non-conductor bulkhead connector taken on line 5—5 of FIG. 4.

Since bulkhead connectors 22 and 26 are identical, FIGS. 4 and 5 show only non-conductor bulkhead connector 22 in detail. Inlet end 48 of tubing 46 is removably and sealingly coupled to bulkhead connector 22 which has a main hollow body 66 that defines a threaded external cylindrical wall portion 65, which is loosely inserted through an orifice 19 in top cap 18. Two circular top and bottom openings are provided in body 66 from which outwardly extend tubular anchoring sleeves 68 and 69, respectively. A radially-extending inner annular lip 70 maintains metal tubes 24 and 48 in spaced apart relationship.

Sleeves 68, 69 have fingers 71, 72, respectively, that are free to slide to a very limited extent on tapered walls 73', 74', respectively, which are extensions of cylindrical walls 73, 74, respectively. Fingers 71, 72 carry in a horizontal plane a plurality of radially-extending anchoring metal inserts 71' and 72', respectively. A cap 76 threadedly engages the threaded cylindrical wall portion 65, thereby clampingly securing body 66 and compressing an external seal ring 78. The internal fluid tightness of body 66 is maintained by a top inner O-ring 80 and by a bottom inner O-ring 82.

In use, pipe 24 is inserted through metal inserts 71' and O-ring 80, and pipe 48 is inserted through metal inserts 72' and O-ring 82. Pipes 24 and 48 become anchored to body 66 by slightly pulling out sleeves 68 and 69, respectively. Conversely, pipes 24 and 48 become freed by pushing in sleeves 68 and 69, respectively. Thus, sleeves 68 and 69 accept for quick connect/disconnect the end portions of pipes 24 and 48, without the need for soldered connections, and hold them together against downward movements while allowing them rotational movements.

Hence, bulkhead connectors 22,26 allow prechiller unit 10 to become simply and easily connected to or removed from ice machine 30.

Body 66 and sleeves 68, 69 are made of non-conductor materials, such as plastics, exhibiting a very high resistivity to the flow of electric current therethrough, so that no appreciable electric current can flow either directly between pipes 24 and 48 or through body 66, thereby effectively electrically insulating tubing 46 which forms heat exchanger 40.

We believe that the non-conductor material of main body 66, which effectively prevents electric current flow between pipes 24 and 48, is responsible for maintaining the wetted surfaces of tubing 46 substantially free of mineral accumulation, even when the tap water flowing therethrough originates from wells situated in lime formations.

Thus, in accordance with this invention, each bulkhead connector 22 or 26 has a dual purpose: to operatively and detachably couple in a leakproof manner heat exchanger 40 to a source of tap water feeding the heat exchanger, and to provide a high resistance to the flow of electric current between the heat exchanger's copper tubing 46, ice machine 30, and ground.

The preferred embodiment for optimum thermal efficiency and adapted for use in most ice maker installations, utilized refrigeration grade copper tubing having a ⅜" outside diameter (OD) and a wall thickness of 0.035". Casing 12 had a 4" OD, a height of 26", and a reservoir 14 whose volume was 1.44 gallons. For smaller machines, four feet of copper tubing per linear foot of casing 12 is adequate.

However, for use on a wide range of ice makers from small to large sizes and for optimum thermal efficiency, about 23 feet of copper tubing per linear foot of casing 12 is preferred. In this case, the total length of tubing 46 is 48 feet yielding 54 coil turns 52, an outside diameter of coil 50 of 3.6", an inside diameter of coil 50 of 2.9", and a length of straight tube 44 of 25.5". Thus, in the universal 4" OD cylindrical casing 12, the coil should use between 4 and 23 feet of copper tubing per linear foot of casing 12. The volume of reservoir 14, with the tubing 46 inside, is about 1.13 gallons for about 23 feet of tubing per linear foot of casing 12 having about 4" outside diameter and about 26" in length.

Other preferred dimensions include:

caps 16 and 18: 4" diameter hollow member 46: 1" OD, 23" length bulkhead connectors 22, 26: ⅜" to ⅜"

These non-conductor bulkhead unions or connectors 22, 26 were purchased from Cole-Parmer Instrument Company, P.O. Box 48898, Niles, Ill. 60714-0898 under Catalog No.L-06372-61. The manufacturer of connectors 22, 26 is John Guest Southern Ltd., believed to have an office in Middlesex England.

The present invention may be carried out in various ways and is not limited to the specific way described above, which is at present the best mode contemplated for accomplishing the objectives previously enumerated, as well as other objectives which will become apparent to those skilled in the art.

For example, while it is preferred for casing 12 to remain upright, in use, the prechiller 10 will function with the casing 12 in an inclined or horizontal position but at a sacrifice in thermal heat exchange efficiency between the warm tap water and the cold waste water 54.

Figure 6:
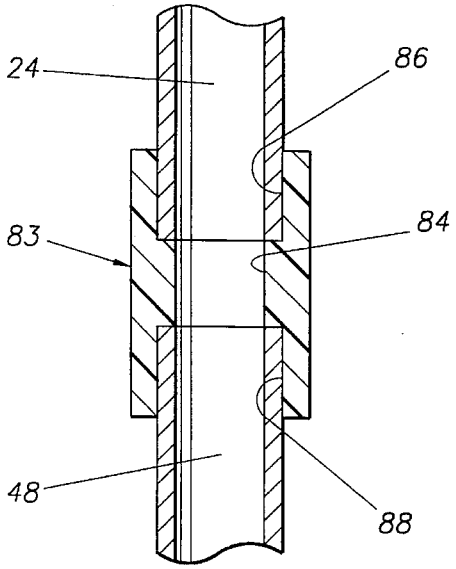
FIG. 6 is a sectional view of a simplified but less desirable pipe connector, which is made of a non-conductor material, and which therefore could alleviate the mineral buildup problem.

Instead of the desired bulkhead connector 22, a less desired straight pipe coupler 83 (FIG. 6) can be employed. It has an inwardly and radially extending shoulder 84 at the center thereof, thereby defining top and bottom sockets 86, 88 for receiving the free ends 24 and 48, which are physically separated from each other by the annular shoulder 84.

Coupler 83 is also made of a non-conductor material, such as plastic, exhibiting a very high resistivity to the flow of electric current therethrough, so that no appreciable electric current can flow either directly between pipes 24 and 48 or through the body of coupler 83, thereby effectively preventing the flow of electric current between the heat exchanger's copper tubing 46, ice machine 30 and ground.

In use, however, because pipe 24 needs to be fixedly secured to socket 86 and pipe 48 to socket 88, coupler 83 lacks the very important quick connect/disconnect advantage offered by bulkhead connectors 22 and 26.

Figure 7:
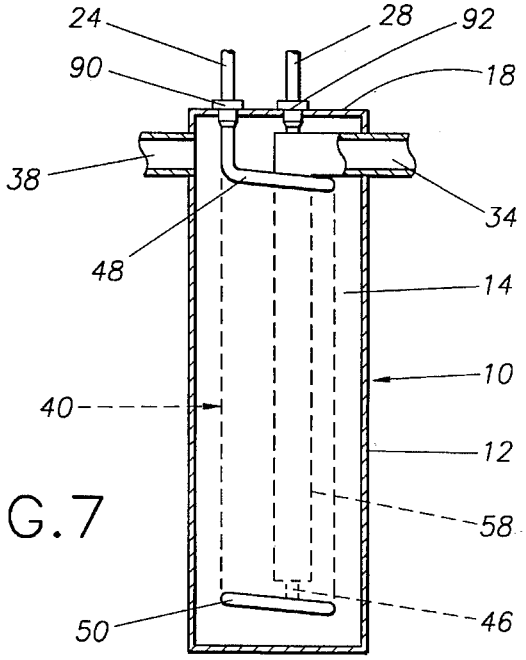
FIG. 7 is a schematic view of the prechiller using less desirable metal bulkhead connectors, which allow electric current flow therethrough, and which therefore do not alleviate the mineral buildup problem.

Instead of the desired non-conductor bulkhead connectors 22, 26, less desired identical bulkhead connectors 90 and 92 can be employed as shown in FIG. 7. The main difference between bulkhead connectors 90, 92, and 22, 26 is that the body of bulkhead connector 90 is made of metal and not of a non-conductor material. Otherwise, the construction of each metal bulkhead connector 90 or 92 is identical to that of bulkhead connector 22. Thus, because the heat exchanger 40 will not become electrically insulated as desired, it will provide a continuous low electric resistivity path from ice machine 30 to ground. As a result, bulkhead connector 90 will encourage the undesired tendency of mineral accumulation on and around heat exchanger 40.

In sum, while metallic bulkhead connectors 90 and 92 cannot serve the purpose of electrically isolating heat exchanger 40, they can be used for providing quick connect/disconnect of pipe ends 24 and 48.

It will be readily apparent that our novel tap water prechiller 10 offers a very simple, practical, unique and inexpensive approach to a very difficult sediment precipitation problem, which, although recognized by others in the heat exchanger art, had not been heretofore effectively addressed.

What is claimed is:

1. In an apparatus for prechilling the warm tap water, fed into an ice maker machine to make ice cubes and the like, with the near freezing waste water ejected by the machine after one or more ice making cycles, comprising: an insulated, elongated casing having top and bottom ends forming there between a closed reservoir housing a heat exchanger made of copper tubing or the like, said casing having a waste water inlet, a tap water inlet, a waste water overflow outlet, and a tap water outlet, the improvement wherein:

said heat exchanger has a coil having a plurality of spiral turns for maximum heat transfer followed by a substantially straight tube portion within and surrounded by said turns;

a first bulkhead connector connected to the inlet of said coil, a second bulkhead connector connected to the outlet of said straight tube, and each bulkhead connector being made at least in part of a material exhibiting a high resistivity to the flow of electric current, thereby insulating said coil from electric current flow therethrough;

a hollow member, closed at one end, spaced from said straight tube to be surrounded by said coil turns to form between said hollow member and said straight tube an elongated chamber whose bottom is open to the interior of said reservoir; and said chamber is fluidly coupled to said waste water inlet, said coil is fluidly coupled to said tap water inlet, and said straight tube is fluidly coupled to said tap water outlet, whereby in use said warm tap water flows under pressure spirally toward the lowest one of said coil turns, thence within said straight tube and through said tap water outlet into said machine for making ice; and said cold waste water flows through said chamber, along and around said straight tube, into the interior of said reservoir, and therein along and around said coil turns, and exiting through said overflow outlet, thereby progressively and continuously increasing the temperature of said waste water after it is received from the machine and progressively and continuously decreasing the temperature of said tap water until it reaches said tap water outlet, whereat it has its lowest temperature.

2. In a method for exchanging thermal energy between a first fluid with a sediment-contaminated second fluid using a casing forming a reservoir for housing a heat exchanger made of metal tubing having a fluid inlet and a fluid outlet, the improvement including:

a) connecting at least one connector, made at least in part of a material exhibiting a high electric resistivity, to said inlet of said tubing;

b) feeding said second fluid into said reservoir from which it flows outside of said casing; and c) feeding said first fluid into said heat exchanger through said one connector so that said fluids become in heat exchange relationship, thereby substantially reducing the tendency for progressive precipitation of sediments from said second fluid onto the outer surfaces of said metal tubing while thermal energy is being exchanged between said fluids.

3. The method of exchanging thermal energy according to claim 2, and connecting at least a second connector, made at least in part of a material exhibiting a high electric resistivity, to said outlet of said tubing.

4. The method of exchanging thermal energy according to claim 2, wherein said one connector is a bulkhead connector.

5. The method of exchanging thermal energy according to claim 3, wherein each one of said connectors is a bulkhead connector.

6. The method of exchanging thermal energy according to claim 4, wherein said tubing is made of copper or the like;

said heat exchanger includes at least in part a coil having a plurality of spiral turns followed by a substantially straight tube portion within and surrounded by said coil turns; and mounting a hollow member in spaced relation to said straight tube to be surrounded by said coil's turns to form between said hollow member and said straight tube an elongated chamber whose bottom is open to the interior of said reservoir.

7. The method of exchanging thermal energy according to claim 5, wherein said tubing is made of copper or the like;

said heat exchanger includes at least in part a coil having a plurality of spiral turns followed by a substantially straight tube portion within and surrounded by said coil turns; and mounting a hollow member in spaced relation to said straight tube to be surrounded by said coil's turns to form between said hollow member and said straight tube an elongated chamber whose bottom is open to the interior of said reservoir.

8. A method for prechilling the warm tap water, fed into an ice maker machine to make ice cubes and the like, with the near freezing waste water ejected by the machine after one or more ice making cycles, comprising:

a) using a casing having top and bottom ends forming therebetween a closed reservoir housing a heat exchanger made of heat conducting metal tubing having a low electric resistivity, said tubing having an inlet and an outlet and being wound at least in part into a coil;

b) connecting at least one connector, made at least in part of a material exhibiting a high electric resistivity, to said inlet of said tubing;

c) feeding said tap water into said coil through said connector; and d) feeding said waste water into said reservoir wherein said tap and waste waters become in heat exchange relationship and from which said waste water and substantially all sediments, if any contained in said waste water, flow outside of said casing, thereby maintaining the outer surfaces of said metal tubing substantially free of sediments, while said tap water is being precooled by said waste water.

9. The method of prechilling the warm tap water according to claim 8, wherein said one connector is a bulkhead connector.

10. The method of prechilling the warm tap water according to claim 9, and connecting at least a second connector, made at least in part of a material exhibiting a high electric resistivity, to said outlet of said tubing.

11. The method of prechilling the warm tap water according to claim 10, wherein said tubing is made of copper tubing or the like, and said coil having a plurality of spiral turns followed by a substantially straight tube portion within and surrounded by said coil turns; and mounting a hollow member in spaced relation to said straight tube to be surrounded by said coil's turns to form between said hollow member and said straight tube an elongated chamber whose bottom is open to the interior of said reservoir.

12. A method of precooling tap water for use by an ice maker machine which produces as a byproduct cold waste water, comprising:

a) using a two-stage precooler including a thermally isolating casing enclosing a first precooling chamber, a heat conducting metal tube comprised of a coiled first tube part and of a second tube part, said coiled first tube part being disposed in said first precooling chamber, a conduit mounted in said coiled first tube part to be surrounded thereby, and said second tube part being disposed in said conduit so that the space between said second tube part and the inner wall of said conduit forms a second precooling chamber, a first connector connected to said coiled first tube part, a second connector connected to said second tube part, and each connector being made at least in part of a material exhibiting a high electric resistivity, and during each icemaking cycle;

b) feeding said cold waste water from said machine into said second precooling chamber from where it flows into said first precooling chamber from which it flows outside of said casing together with the sediments, if any contained therein, thereby substantially reducing the tendency for progressive precipitation of sediments from said waste water onto the outer surfaces of said metal tubing while thermal energy is being exchanged between said tap and waste waters;

c) feeding said tap water into said coiled first tube part where it becomes precooled by said waste water flowing through said first precooling chamber;

d) feeding said precooled tap water into said second tube part, so that said tap water, in said first and second tube parts, and said waste water, in said first and second chambers, flow in opposite directions, and said cold waste water flowing through said second chamber further cools said precooled tap water flowing in said second tube part; and e) feeding said twice precooled tap water from said second tube part into said machine for making ice.

13. A method of precooling tap water according to claim 12, wherein said first and second connectors are bulkhead connectors.

* * * * *